US010589963B2

(12) United States Patent
Billard et al.

(10) Patent No.: US 10,589,963 B2
(45) Date of Patent: Mar. 17, 2020

(54) ELEVATOR SAFETY GEAR ALIGNMENT SYSTEM AND METHOD

(71) Applicants: OTIS ELEVATOR COMPANY, Farmington, CT (US); Justin Billard, Amston, CT (US); Andrés Monzon, Alcoron, Madrid (ES)

(72) Inventors: Justin Billard, Amston, CT (US); Andrés Monzon, Madrid (ES); Richard N. Fargo, Plainville, CT (US); Nicolas Fonteneau, Vitry aux Loges (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 242 days.

(21) Appl. No.: 15/565,053

(22) PCT Filed: Apr. 10, 2015

(86) PCT No.: PCT/EP2015/057835
§ 371 (c)(1),
(2) Date: Oct. 6, 2017

(87) PCT Pub. No.: WO2016/162084
PCT Pub. Date: Oct. 13, 2016

(65) Prior Publication Data

US 2018/0118518 A1 May 3, 2018

(51) Int. Cl.
*B66B 11/02* (2006.01)
*B66B 5/16* (2006.01)
(Continued)

(52) U.S. Cl.
CPC ..... *B66B 11/0246* (2013.01); *B66B 5/16* (2013.01); *B66B 7/021* (2013.01); *B66B 19/00* (2013.01); *B66B 5/0087* (2013.01); *B66B 19/007* (2013.01)

(58) Field of Classification Search
CPC ..... B66B 11/0246; B66B 5/16; B66B 7/021; B66B 19/00
See application file for complete search history.

(56) References Cited

U.S. PATENT DOCUMENTS 2,194,134 A * 3/1940 Berryman ..... E21D 1/03 187/410
6,302,240 B1 * 10/2001 Shih ..... B66B 1/461 187/397
(Continued)

FOREIGN PATENT DOCUMENTS

CN 2439021 Y 7/2001
CN 101321679 A 12/2008
(Continued)

OTHER PUBLICATIONS

International Search Report and Written Opinion regarding related PCT App. No. PCT/EP2015/057835; dated Dec. 15, 2015.
(Continued)

*Primary Examiner* — Michael A Riegelman
(74) *Attorney, Agent, or Firm* — Cantor Colburn LLP

(57) ABSTRACT

A safety gear alignment system for an elevator system includes an elevator shaft and an elevator car having an interior region and disposed in and moveable within the elevator shaft. Also included is an upright structure operatively coupled to the elevator car, the upright structure defining at least one aperture. Further included is a safety gear member having a brake and a frame, the frame operatively coupled to the upright structure. Yet further included is at least one access region defined by the frame of the safety gear member, the access region accessible from the interior region of the elevator car and wherein measurement between the frame and a guide rail of the elevator shaft is made for alignment of the safety gear member relative to the guide rail.

8 Claims, 3 Drawing Sheets

(51) Int. Cl.

| | |
|---|---|
| ***B66B 19/00*** | (2006.01) |
| ***B66B 7/02*** | (2006.01) |
| *B66B 5/00* | (2006.01) |

(56) References Cited

U.S. PATENT DOCUMENTS

| | | | | |
|---|---|---|---|---|
| 6,739,431 | B1 * | 5/2004 | Wang | B66B 5/027 187/306 |
| 7,503,433 | B2 * | 3/2009 | Wang | B66B 11/008 187/254 |
| 7,556,126 | B2 * | 7/2009 | Wang | B66B 5/027 187/263 |
| 8,316,998 | B2 * | 11/2012 | Henseler | B66B 11/0246 187/317 |
| 8,820,483 | B2 * | 9/2014 | Ericson | B66B 19/005 187/266 |
| 9,643,815 | B2 * | 5/2017 | Wei | B66B 5/22 |
| 2003/0015378 | A1 * | 1/2003 | Elsener | B66B 11/0246 187/336 |
| 2005/0241886 | A1 * | 11/2005 | Marti | B66B 5/18 187/351 |
| 2009/0159372 | A1 * | 6/2009 | Nygren | B66B 5/26 187/270 |
| 2010/0018811 | A1 * | 1/2010 | Vaudo | B66B 5/0087 187/409 |
| 2010/0200339 | A1 * | 8/2010 | Henseler | B66B 5/005 187/401 |
| 2011/0083926 | A1 * | 4/2011 | Rasanes | B66B 5/0087 187/300 |
| 2012/0048658 | A1 * | 3/2012 | Brugger | B66B 11/0206 187/401 |
| 2015/0246792 | A1 * | 9/2015 | Baltis | B66B 11/0246 187/276 |
| 2015/0298938 | A1 * | 10/2015 | Fargo | B66B 7/046 187/401 |
| 2018/0009633 | A1 * | 1/2018 | Fargo | B66B 19/002 |
| 2018/0118516 | A1 * | 5/2018 | Marti | B66B 5/22 |
| 2018/0118518 | A1 * | 5/2018 | Billard | B66B 19/00 |
| 2018/0118519 | A1 * | 5/2018 | Fonteneau | B66B 11/0246 |
| 2019/0106296 | A1 * | 4/2019 | Barneman | B66B 19/002 |
| 2019/0177114 | A1 * | 6/2019 | Fargo | B66B 1/32 |

FOREIGN PATENT DOCUMENTS

| | | | |
|---|---|---|---|
| CN | 101821185 | A | 9/2010 |
| CN | 203255828 | U | 10/2013 |
| CN | 203624760 | U | 6/2014 |
| CN | 203938307 | U | 11/2014 |
| EP | 1056679 | A2 | 12/2000 |
| EP | 1333000 | A1 | 6/2003 |
| EP | 1433734 | A1 | 6/2004 |
| EP | 1471026 | A1 | 10/2004 |
| EP | 1498381 | A1 | 1/2005 |
| EP | 2091855 | A1 | 8/2009 |
| EP | 2361214 | A1 | 8/2011 |
| EP | 2551228 | A1 | 1/2013 |
| EP | 2736828 | A1 | 6/2014 |
| EP | 2821358 | A1 | 1/2015 |
| WO | 9711020 | A1 | 3/1997 |
| WO | 2007046742 | A1 | 4/2007 |
| WO | 2009036583 | A1 | 3/2009 |
| WO | 2010052364 | A1 | 5/2010 |

OTHER PUBLICATIONS

Chinese First Office Action for application 201580078699.6, dated Apr. 3, 2019, 7 pages.

* cited by examiner

ELEVATOR SAFETY GEAR ALIGNMENT SYSTEM AND METHOD

CROSS-REFERENCE TO RELATED APPLICATIONS

This patent application is a National Stage Application of International Patent Application Serial No. PCT/EP2015/057835 filed on Apr. 10, 2015, which is incorporated herein by reference in its entirety.

BACKGROUND OF THE INVENTION

The embodiments herein generally relate to elevator systems and, more particularly, to a safety gear alignment system for an elevator car of such systems, as well as a method of aligning safety gears for an elevator car from an interior region of the elevator car.

Elevators with a shallow pit and/or a low overhead are advantageous because of the reduced impact of their installation on the construction cost and because of the compatibility with severe architectural constraints. However, mechanics are currently tasked with going to the top of the car, or into the pit for inspection or maintenance activities. Requiring individuals to be within the elevator shaft and outside of the elevator car poses complex and/or cumbersome service tasks based on a small area to work within. As such, certain regulatory measures, particularly in Europe, have been proposed and/or enacted that will require larger spaces at the top of the elevator shaft and within the pit. This required additional space is undesirable from a construction and architectural standpoint, as described above.

One approach to combat the above-noted conflicting interests is to avoid the need for mechanics or otherwise authorized personnel to be in the elevator shaft outside of the elevator car. Unfortunately, traditional elevator systems are typically assembled in a manner that still requires assembly, inspection and maintenance activities to be conducted outside of the elevator car.

BRIEF DESCRIPTION OF THE INVENTION

According to one embodiment, a safety gear alignment system for an elevator system includes an elevator shaft and an elevator car having an interior region and disposed in and moveable within the elevator shaft. Also included is an upright structure operatively coupled to the elevator car and located along an exterior surface of one of the plurality of side walls, the upright structure extending in a longitudinal direction from the car floor to the car roof, the upright structure defining at least one aperture. Further included is a safety gear member having a brake and a frame, the frame operatively coupled to the upright structure. Yet further included is at least one access region defined by the frame of the safety gear member, the access region accessible from the interior region of the elevator car and wherein measurement between the frame and a guide rail of the elevator shaft is made for alignment of the safety gear member relative to the guide rail.

In addition to one or more of the features described above, or as an alternative, further embodiments may include that the access region comprises a notch.

In addition to one or more of the features described above, or as an alternative, further embodiments may include that the access region comprises a pair of slots.

In addition to one or more of the features described above, or as an alternative, further embodiments may include that the at least one access region comprises a first shim receiving region and a second shim receiving region each defined by the frame. The safety gear alignment system includes a first pair of shims extendable from the interior region of the elevator car through the at least one aperture of the upright structure and into the first shim receiving region of the safety gear member, the first pair of shims aligning the safety gear member relative to the guide rail of the elevator shaft. The safety gear alignment system further includes a second pair of shims extendable from the interior region of the elevator car through the at least one aperture of the upright structure and into the second shim receiving region.

In addition to one or more of the features described above, or as an alternative, further embodiments may include that the first shim receiving region comprises a first notch and the second shim region comprises a second notch.

In addition to one or more of the features described above, or as an alternative, further embodiments may include that the first notch is located at a top end of the frame of the safety gear member and the second notch is located at a bottom end of the frame.

In addition to one or more of the features described above, or as an alternative, further embodiments may include that the first shim receiving region comprises a first pair of slots and the second shim receiving region comprises a second pair of slots.

In addition to one or more of the features described above, or as an alternative, further embodiments may include that the first pair of slots is disposed proximate a top end of the frame of the safety gear member and the second pair of slots is disposed proximate a central region of the frame.

According to another embodiment of the invention, a method of aligning a safety gear member of an elevator car is provided. The method includes disposing a safety gear member into proximity with an upright structure operatively coupled to an elevator car. The method also includes aligning a first access region of a frame of the safety gear member with at least one aperture defined by the upright structure. The method further includes measuring a gap between the frame and a guide rail of an elevator shaft from an interior region of the elevator car for aligning the safety gear member relative to the guide rail located at an exterior region of the elevator car.

In addition to one or more of the features described above, or as an alternative, further embodiments may include that the first access region comprises a first shim receiving region and measuring the gap includes inserting a first pair of shims from the interior region of the elevator car through the at least one aperture defined by the upright structure and through the first shim receiving region. Measuring the gap also includes inserting a second pair of shims from the interior region of the elevator car through the upright structure and through a second shim receiving region defined by the frame of the safety gear member.

In addition to one or more of the features described above, or as an alternative, further embodiments may include that the first shim receiving region comprises a first notch located at a top end of the frame and the second shim receiving region comprises a second notch located at a bottom end of the frame.

In addition to one or more of the features described above, or as an alternative, further embodiments may include that the first shim receiving region comprises a first pair of slots and the second shim receiving region comprises a second pair of slots.

In addition to one or more of the features described above, or as an alternative, further embodiments may include operatively coupling the safety gear member to the upright structure by a user located in the interior region of the elevator car.

In addition to one or more of the features described above, or as an alternative, further embodiments may include that measuring the gap between the frame and the guide rail comprises visually inspecting the gap.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
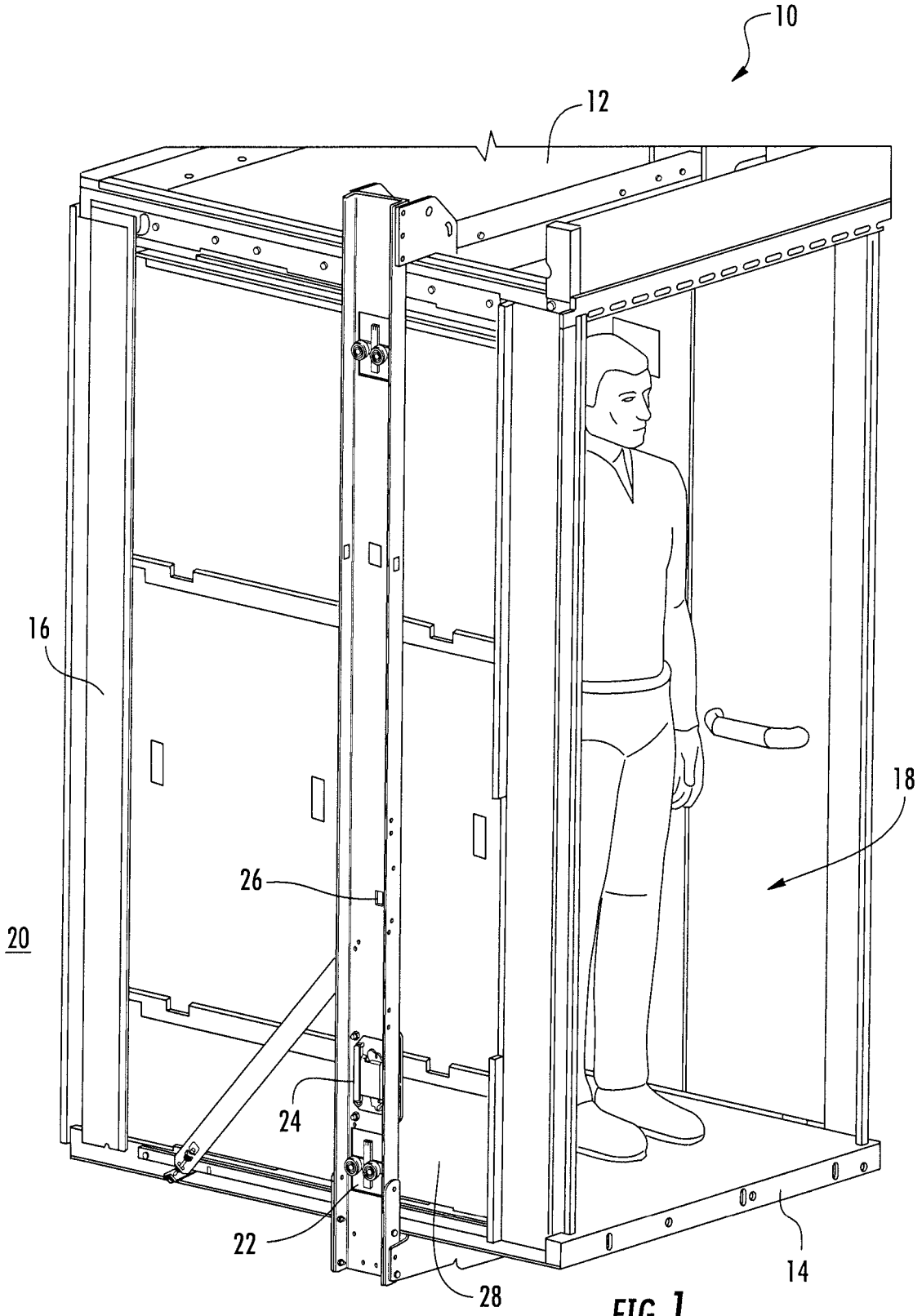
FIG. 1 is a perspective view of an elevator car.

Referring to FIG. 1 an elevator car 10 is illustrated. The elevator car 10 moves along guide rails of an elevator shaft in a known manner. The elevator car 10 is disposed within the elevator shaft and is moveable therein, typically in a vertical manner. The elevator car 10 includes a car roof 12, a car floor 14 and a plurality of side walls 16. Together, the car roof 12, the car floor 14 and the plurality of side walls 16 define an interior region 18 that is dimensioned to carry standing passengers and/or cargo during operation of the elevator car within the overall elevator system.

The region surrounding the elevator car 10, specifically the region surrounding exterior surfaces of the car roof 12, the car floor 14 and the plurality of side walls 16, is referred to herein as an exterior region 20. Generally, the exterior region 20 includes surrounding space within the elevator shaft through which the elevator car 10 travels. Interfaces between the elevator car 10 and equipment required to facilitate desired movement of the elevator car 10 are located within the exterior region 20. For example, a guide rail that is fixedly coupled to a wall of the elevator shaft interacts with one or more guiding members 22 attached to an exterior surface of the elevator car 10 to properly guide, and possibly actuate movement, of the elevator car 10. Additionally, a safety gear member 24 is positioned to engage the guide rail within the exterior region 20 in the event of a safety braking event.

The guiding member(s) 22 and the safety gear member 24 are coupled to an upright structure 26 in some embodiments. The upright structure 26 is a structure that is operatively coupled to the elevator car 10 and is located within the exterior region 20 and extends along an exterior surface 28 of one of the plurality of side walls 16. The upright structure 26 extends in a longitudinal direction from the car roof 12 to the car floor 14. Although illustrated as extending along an entire height of the elevator car 10, it is to be appreciated that the upright structure 26 may extend only partially relative to the height of the elevator car 10.

Figure 3:
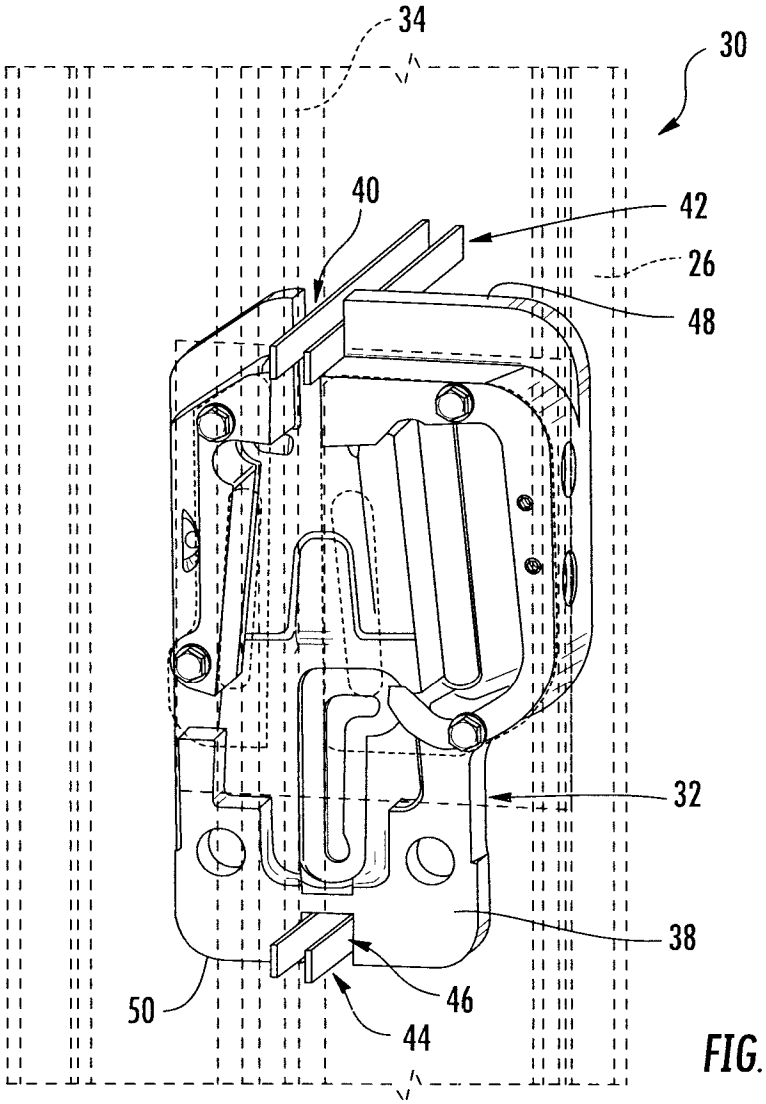
FIG. 3 is a perspective view of a safety gear alignment system for aligning the safety gear member of FIG. 2.
Figure 2:
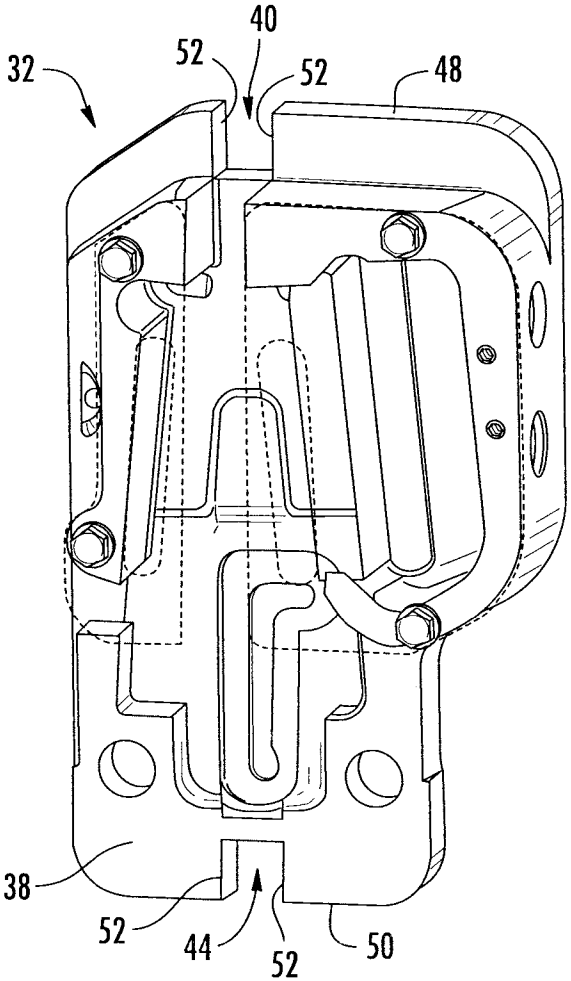
FIG. 2 is a perspective view of a safety gear member according to a first embodiment.

Referring now to FIGS. 2 and 3, a safety gear alignment system 30 for the elevator car 10 is illustrated according to a first embodiment. As will be appreciated from the description herein, the safety gear alignment system 30 is provided to advantageously allow a safety gear member 32, that require exposure to the exterior region 20 to be properly aligned from the interior region 18 of the elevator car 10. Such an assembly eliminates the need for personnel to be situated within the elevator shaft in the exterior region 20 relative to the elevator car 10, thereby avoiding certain hazards associated with such positioning.

The safety gear member 32 is provided to be in close engagement with a guide rail 34. Although the elevator car 10 is provided with a primary braking system that operates during normal conditions, in the event of a runaway or freefall event the safety gear member 32 is provided to stop the elevator car 10 by engaging a brake with the guide rail 34. Alignment of the safety gear member 32 relative to the guide rail 34 is needed to avoid portions of the safety gear member 32 from scraping against the guide rail 34 as the elevator car 10 moves within the elevator shaft during normal operation. The alignment requires a small space to be provided between the components of the safety gear member 32 and the guide rail 34. Rather than performing this alignment from the exterior region 20, the safety gear alignment system 30 allows a user to be positioned within the interior region 18 of the elevator car 10 to fully carry out the alignment of the safety gear member 32.

The upright structure 26 defines at least one aperture that is accessible from the interior region 18 of the elevator car 10. The safety gear member 32 includes a frame 38 that facilitates operative coupling of the safety gear member 32 to the upright structure 26. Coupling of the frame 38 to the upright structure 26 may be done from the interior region 18 of the elevator car 10 via one or more mechanical fasteners or the like. The frame 38 defines at least one access region that is accessible from the interior region 18 of the elevator car. The access region may be any access point, such as a path or opening that allows a user to measure a gap between the frame 38 and a guide rail for alignment purposes of the frame 38 relative to the guide rail. The access region may facilitate visual inspection of the gap and/or physical measurement with one or more components. For purposes of illustration and discussion, an embodiment that utilizes shims or the like for insertion into the access region is described in detail below, but it is to be appreciated that other components or mere visual inspection may be utilized.

In some embodiments, the frame 38 defines a first shim receiving region 40 that provides a region for a first pair of shims 42 to be inserted therethrough for aligning the safety gear member 32 relative to the guide rail 34. Although it is contemplated that a single shim receiving region may be employed to properly facilitate alignment, the system 30 may also include a second shim receiving region 44 that provides a region for a second pair of shims 46 to be inserted therethrough for aligning the safety gear member 32 relative to the guide rail 34.

In the illustrated embodiment of FIGS. 2 and 3, the first shim receiving region 40 and the second shim receiving region 44 are notches 40, 44 that are cutout regions from respective ends of the frame 38 of the safety gear member 32. In particular, the first notch 40 is located at a top end 48 of the frame 38 and the second notch 44 is located at a bottom end 50 of the frame 38. Upon insertion of the first and second pair of shims 42, 46 through the upright structure 26 and the first notch 40 and the second notch 44, respectively, the shims are spread out toward respective sidewalls 52 of the notches. This spreading is conducted until translation of all four shims past the guide rail 34 is possible. Upon such translation by all four shims, the frame 38, and therefore the safety gear member 32 is deemed to be properly aligned relative to the guide rail 34. Subsequently, the frame 38 is operatively coupled to the upright structure 26 in the aligned, desirable position.

Figure 5:
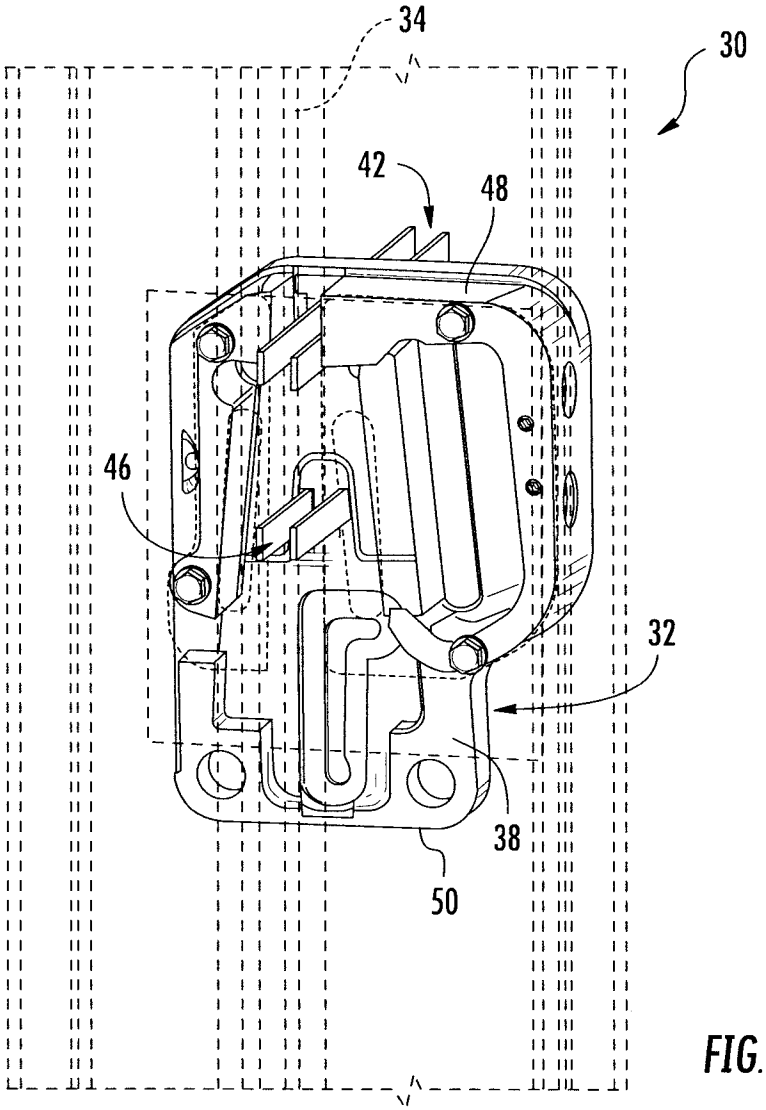
FIG. 5 is a perspective view of a safety gear alignment system for aligning the safety gear member of FIG. 4.
Figure 4:
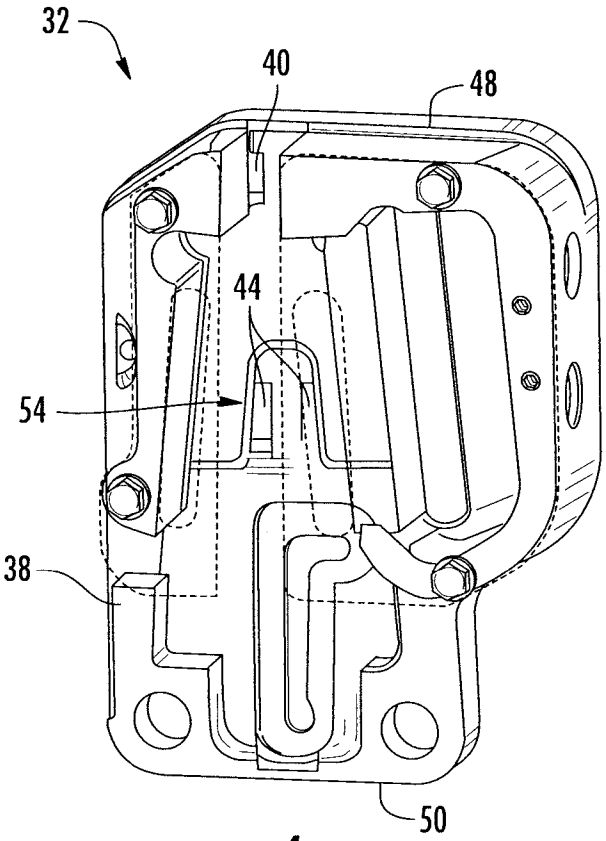
FIG. 4 is a perspective view of a safety gear member according to a second embodiment.

Referring now to FIGS. 4 and 5, the safety gear alignment system 30 for the elevator car 10 is illustrated according to a second embodiment. The second embodiment of the system 30 is similar in many respects to the first embodiment discussed in detail above and illustrated in FIGS. 2 and 3. However, the first and second shim receiving regions 40, 44 of the embodiment of FIGS. 4 and 5 are slots defined by the frame 38 of the safety gear member 32. In particular, the first shim receiving region 40 is a first pair of slots and the second shim receiving region 44 is a second pair of slots. The slots are sized to receive the first and second pairs of shims 42, 46 therethrough for alignment of the frame 38, and therefore the overall safety gear member 32 relative to the guide rail 34. The slots are typically vertically oriented.

The first pair of slots is spaced from the second pair of slots by a distance sufficient to reliably align the safety gear member 32 relative to the guide rail 34. In the illustrated embodiment, the first pair of slots is located proximate the top end 48 of the frame 38, while the second pair of slots is located proximate a central region 54 of the frame 38. It is to be understood that alternative spacing of the slot pairs may be suitable. For example, the first pair of slots may located proximate the top end 48 and the second pair of slots may be located proximate the bottom end 50. By way of yet another non-limiting example, the first pair of slots may be located proximate the central region 54 and the second pair of slots may be located proximate the bottom end 50.

Similar to the first embodiment, insertion of the first and second pair of shims 42, 46 is made through the upright structure 26 and the first pair of slots and the second pair of slots, respectively. The safety gear member 32 is manipulated until translation of all four shims past the guide rail 34 is possible. Upon such translation by all four shims, the frame 38, and therefore the safety gear member 32 is deemed to be properly aligned relative to the guide rail 34. Subsequently, the frame 38 is operatively coupled to the upright structure 26 in the aligned, desirable position.

Although the illustrated embodiments show embodiments having the same type of shim receiving regions (i.e., notches and slots), it is contemplated that alternative types of receiving regions may be employed. Furthermore, the type of receiving region may be mixed. For example, a notch may be combined with a slot.

Advantageously, the safety gear alignment assembly 30 provides field friendly alignment procedures for safety gear members that are required to be exposed to the exterior region 20 of the elevator car 10. By providing an assembly that facilitates complete alignment of the safety gears from the interior region 18 of the elevator car 10, issues associated with service activities being performed by a user in the exterior region 20 are overcome. In particular, a user no longer needs to be located on top of or below the elevator car 10 to carry out the service activities described herein. This assembly and method allows regions of an associated elevator shaft to be reduced in volume, which is desirable for architectural considerations, while complying with proposed and/or enacted standards.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A safety gear alignment system for an elevator system comprising:

an elevator shaft;

an elevator car having an interior region and disposed in and moveable within the elevator shaft;

an upright structure operatively coupled to the elevator car and located along an exterior surface of one of the plurality of side walls, the upright structure extending in a longitudinal direction from the car floor to the car roof, the upright structure defining at least one aperture;

a safety gear member having a brake and a frame, the frame operatively coupled to the upright structure; and at least one access region defined by the frame of the safety gear member, the access region accessible from the interior region of the elevator car and wherein measurement between the frame and a guide rail of the elevator shaft is made for alignment of the safety gear member relative to the guide rail.

2. The safety gear alignment system of claim 1, wherein the access region comprises a notch.

3. The safety gear alignment system of claim 1, wherein the access region comprises a pair of slots.

4. The safety gear alignment system of claim 1, wherein the at least one access region comprises a first shim receiving region and a second shim receiving region each defined by the frame, the safety gear alignment system further comprising:

a first pair of shims extendable from the interior region of the elevator car through the at least one aperture of the upright structure and into the first shim receiving region of the safety gear member, the first pair of shims aligning the safety gear member relative to the guide rail of the elevator shaft; and a second pair of shims extendable from the interior region of the elevator car through the at least one aperture of the upright structure and into the second shim receiving region.

5. The safety gear alignment system of claim 4, wherein the first shim receiving region comprises a first notch and the second shim region comprises a second notch.

6. The safety gear alignment system of claim 5, wherein the first notch is located at a top end of the frame of the safety gear member and the second notch is located at a bottom end of the frame.

7. The safety gear alignment system of claim 4, wherein the first shim receiving region comprises a first pair of slots and the second shim receiving region comprises a second pair of slots.

8. The safety gear alignment system of claim 7, wherein the first pair of slots is disposed proximate a top end of the frame of the safety gear member and the second pair of slots is disposed proximate a central region of the frame.

* * * * *